United States Patent [19]

Flaig et al.

[11] 4,326,916

[45] Apr. 27, 1982

[54] BREAST BOX NOZZLE FOR A PAPER MACHINE

[75] Inventors: Heinrich Flaig, Heidenheim; Karl Wolf, Heidenheim-Schnaitheim, both of Fed. Rep. of Germany

[73] Assignee: J. M. Voith, GmbH, Heidenheim, Fed. Rep. of Germany

[21] Appl. No.: 197,519

[22] Filed: Oct. 16, 1980

[30] Foreign Application Priority Data

Oct. 24, 1979 [DE] Fed. Rep. of Germany ..... 2942966

[51] Int. Cl.[3] ..... D21F 1/06

[52] U.S. Cl. ..... 162/344; 162/347

[58] Field of Search ..... 162/344, 347

[56] References Cited

U.S. PATENT DOCUMENTS

| | | | |
|---|---|---|---|
| 2,928,464 | 3/1960 | Western et al. | 162/347 |
| 2,993,538 | 7/1961 | Mustonen | 162/347 |
| 3,167,470 | 1/1965 | Moore | 162/347 |
| 3,645,843 | 2/1972 | Schmaeng | 162/347 |
| 4,008,123 | 2/1977 | Kirjavainen | 162/347 |

FOREIGN PATENT DOCUMENTS

| | | | |
|---|---|---|---|
| 1461176 | 7/1970 | Fed. Rep. of Germany . | |
| 899586 | 6/1962 | United Kingdom | 162/347 |

*Primary Examiner*—Richard V. Fisher

*Attorney, Agent, or Firm*—Lon H. Romanski

[57] ABSTRACT

A breast box nozzle for a paper making machine or the like is shown as having an adjustably positionable shutter member which can be moved generally further and lesser into the path of flow of a stream of pulp stock as to thereby determine the thickness of the discharged stream of pulp stock. A support arrangement applies a pressure to the shutter member as against a downstream side thereof in order to counter the forces generated by the stream of pulp stock upstream of the shutter member and applied as against the upstream side thereof tending to undesirably deform the shutter member. The support arrangement includes an elastomeric member generally interposed between a relatively fixed support member and a downstream side of the shutter member.

6 Claims, 1 Drawing Figure

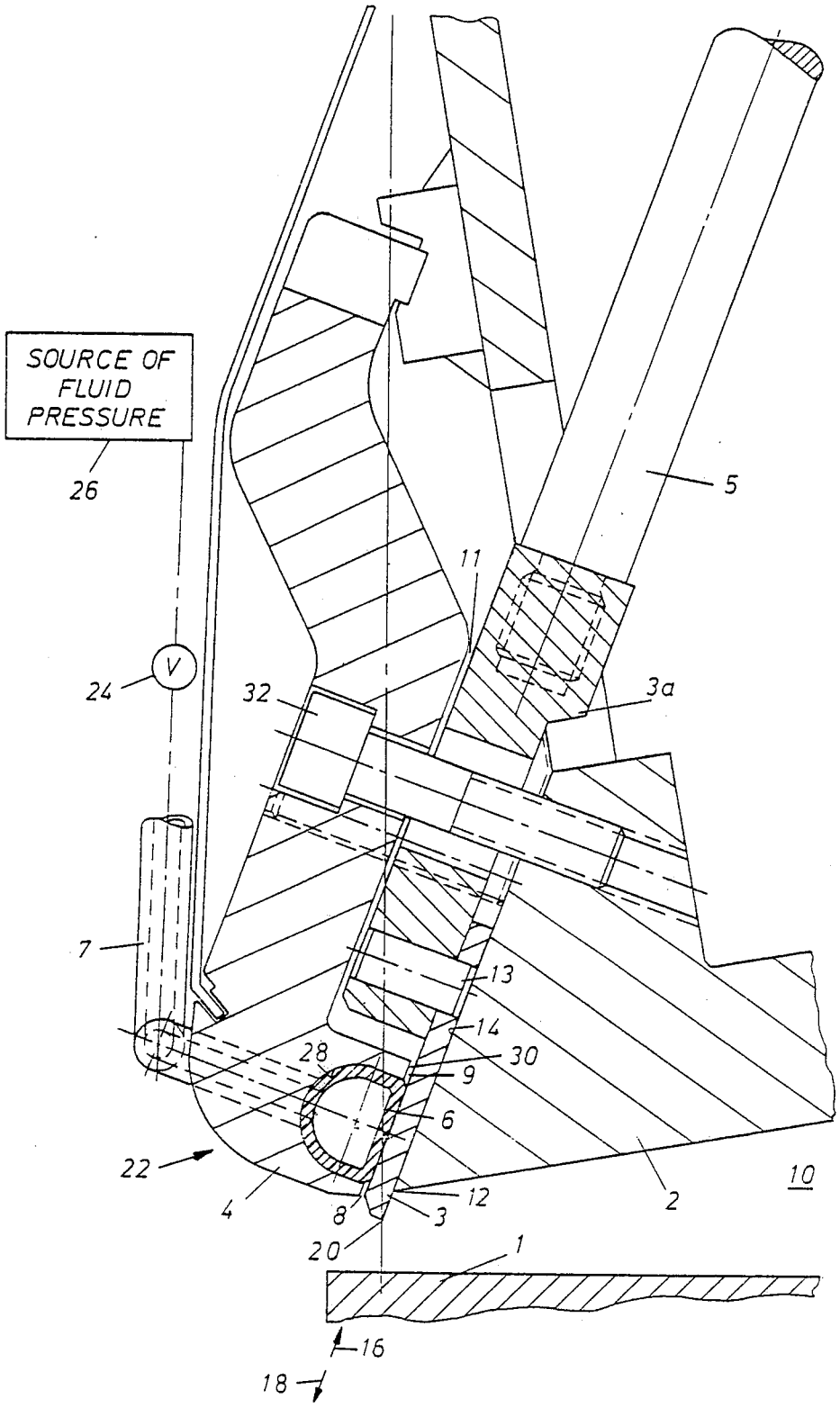
SOURCE OF FLUID PRESSURE
26
24
V
5
11
32
3a
7
13
14
28
30
9
6
22
4
8
12
3
2
10
20
1
16
18

BREAST BOX NOZZLE FOR A PAPER MACHINE

FIELD OF THE INVENTION

This invention relates generally to paper-making machines and more particularly to the nozzle means, of a paper-making apparatus, through which flows a stream of pulp stock.

BACKGROUND OF THE INVENTION

Heretofore it has been known to provide nozzle means, for the breast box of a paper-making machine, wherein the nozzle means comprises an opening or gap, through which pulp stock is flowed, and wherein such opening or gap is comprised of a lower disposed lip or lip surface and an upper disposed lip or lip surface. Further, in such prior art structures a shutter means or member, operatively carried as at a downstream position of such upper lip, can be moved, generally, upwardly and downwardly as to thereby selectively determine the effective height of such opening or gap. Such reciprocal movement of the shutter is usually effected as by a plurality of threaded spindles which operatively engage the shutter and which are operated as by, for example, handwheels or the like.

The thusly selected width of the gap or opening of the breast box nozzle therefore determines the thickness of the stream of pulp stock emerging from the nozzle.

In such arrangements the shutter projects downwardly some amount into the stream of pulp stock and consequently experiences a considerable pressure thereagainst, at the upstream side of the shutter, applied by such flowing stream of pulp stock. Such pressure causes some degree of deflection in the shutter which, in turn, results in uncontrolled variations in the effective width of the nozzle gap causing defects in the resulting paper web.

The prior art has been aware of the problem of such undesired shutter deflection, and the defects in the resulting paper web, and has attempted to solve such problem as by, for example: significantly increasing the thickness of the shutter, which is usually constructed as in the form of a steel straight-edge member; dividing the shutter member into separate sections which are, generally, functionally aligned as to span the entire longitudinal length of the nozzle gap or opening; and providing for a more sensitive adjustment of the threaded adjustment spindles as to thereby, hopefully, offset the effects of the upstream created pressure on the shutter means and eliminate the resulting surface-weight fluctuations occurring in the subsequent paper web, paper, strips and the like. None of such prior art attempts has proven to be successful and such defects and surface-weight fluctuations of the paper web and paper product continued.

In the embodiments of breast box nozzles heretofore employed, a support is provided as to lie directly against, what may be termed, the downstream side of the straight-edge type of shutter. Such support was intended to hold the shutter in such a way as to prevent deformation of the shutter due to the upstream pressure created by the flow of pulp stock. However, despite efforts, the prior art has been unable to manufacture a shutter so dimensionally accurate as to assure that the said support would always rest flush, throughout its length, against the shutter member. The manufacturing tolerances, in order to attain the required flatness, surface parallelism, etc., are extremely critical (and for all practical purposes unattainable) since the slightest undesired curvature or warping of the shutter edge exerts a damaging influence on the quality of the stream of pulp stock and the resulting paper web. Consequently, because of the unattainable dimensional accuracy, the said support, instead of lying flush (along its entire functional length) against the shutter actually engages the shutter only at what amounts to spaced points. Such, of course, only further encourages the undesired bowing or deflection of the shutter. Even with manufacture to close tolerances, due to the considerable temperature fluctuations arising in the area of the shutter, internal and applied material stresses are released which, again, result in the non-flush contact as between the shutter and said support.

The invention as herein disclosed and claimed is primarily directed to the solution of the aforestated and other related and attendant problems.

SUMMARY OF THE INVENTION

According to the invention, a breat box nozzle comprises a nozzle opening extending generally laterally, the nozzle opening being at least in part comprised of an upper disposed lip portion, a shutter operatively carried as to extend across the lateral extent of said opening, said shutter being adjustably positionable relative to said upper lip portion as to thereby selectively adjust the effective height of said opening and thereby select the thickness of the stream of pulp stock flowing through said opening, and support means effective to apply a force against said shutter along the downstream side of said shutter counter to the force created by the pressure of the flow of the paper stock acting against the upstream side of said shutter, said support means comprising force reaction means and elastomeric means, said elastomeric means being generally interposed between said force reaction means and said shutter whereby said elastomeric means is effective to apply to said shutter at least a portion of the force along the downstream side of said shutter.

An object of the invention is to provide a breast box nozzle of the general type described in which irregularities in the stream of pulp stock and defects in the paper web resulting therefrom, particularly surface-weight fluctuations across the paper web, are substantially if not totally eliminated.

Other general and specific objects, advantages and aspects of the invention will become apparent when reference is made to the following detailed description considered in conjunction with the accompanying drawing.

BRIEF DESCRIPTION OF THE DRAWING

The single drawing, wherein for purposes of clarity certain details and/or elements may be omitted, illustrates in general vertical cross-section, a breast box nozzle employing a shutter in accordance with the teachings of the invention.

DETAILED DESCRIPTION OF THE PREFERRED EMBODIMENT

Referring now in greater detail to the drawing, as is generally well known, a source of pulp stock supplies a generally fluid stream of such pulp stock to the nozzle means of the drawing wherein the said nozzle is illustrated as comprising upper disposed lip means 2 and lower disposed lip means 1 which cooperate to define a passageway 10 therebetween (in conjunction with opposite end wall means not shown but well known) for the flow therethrough of said stream of pulp stock. In the embodiment shown, the passageway between lip means 1 and 2 converges as it approaches what could be considered to be the downstream end 12 of upper lip or passage wall 2.

A shutter 3 is placed as against a surface 14, formed as on upper lip structure 2, and is operatively connected to a beam 3*a* and to related adjustment means which may take the form of threaded spindles one of which is typically illustrated at 5. The purpose of such adjustment means, as is well known in the art, is to enable the selective adjustable positioning of the shutter 3 in directions depicted generally by both arrows 16 and 18. In so doing, of course, shutter 3 will move relative to surface 14 and, depending upon the direction of travel, will bring the horizontally extending edge 20 of shutter 3 closer to or further away from the surface of lower lip structure 1 thereby selectively establishing the height, or width, of the discharge opening of nozzle passageway 10 which would otherwise be determined by the distance between end 12 of upper lip structure 2 and lower lip structure 1.

The shutter 3 is, in turn, held in its selectively adjusted position against surface means 14 as by support means 22 which, in the preferred embodiment, is depicted as comprising a support member 4, suitably secured as to the upper lip structure 2, and elastomeric means 6 situated generally between the support member 4 and the shutter 3. In the preferred embodiment, the elastomeric means 6 would extend, generally horizontally, across the functional length of the shutter 3 as to be effective for applying a force, or pressure, thereto counter to that created by the stream of pulp stock flowing in nozzle passageway 10.

Further, in the preferred embodiment of the invention, the elastomeric means 6 comprises an elastomeric hose-like or tubular member which, in turn, is filled with a fluid. Still further, in the preferred embodiment of the invention, the elastomeric hose-like or tubular member 6 is in fluid communication with associated supply conduit means 7, which may comprise pressure regulating valve means 24, leading to a suitable source of fluid pressure 26.

As depicted in the drawing, the elastomeric member 6 may be carried as within a groove-like recess 28 which may be formed in an end surface or portion of support member 4 with such recess being of a relative dimension as to enable the extension of the side of the elastomeric means 6 beyond the end surface 30 of support member 4.

Shutter 3 and beam 3*a* extend, preferably horizontally, across the length of the discharge opening of nozzle passageway 10. Shutter 3 is connected to beam 3*a* by screws (not shown) and by pins, one of which is illustrated at 13. Support member 4 is connected to upper lip structure 2 by support screws one of which is illustrated at 32. It should be noted that spaces or gaps 8 and 9 exist between the end face 30 of support member 4 and shutter 3 besides the elastomeric means 6 and that a further space 11 exists between support member 4 and beam 3*a*. Thus, the invention assures that all counter force is transmitted through elastomeric means 6 and that inspite of said transmission of force the shutter may be adjusted during operation of the breast box nozzle.

OPERATION OF THE INVENTION

Support member 4 may cause an elastomeric deflection of elastomeric means 6 against shutter 3 thereby applying thereto a counter pressure and force generally oppositely directed to that pressure or force existing against the shutter 3 and created by the stream of pulp stock.

That is, as should now be apparent, as the flow of pulp stock is forced through nozzle passageway 10 (from right to left as viewed in the drawing) the stream of pulp stock flows against the depending portion of the upstream side of the shutter means 3 and in so doing applies a pressure thereagainst the resulting force of which tends to bow or move the shutter means in a direction generally away from surface 14 and thereby result in the product defects hereinbefore described.

The invention, by providing what amounts to as an intermediate elastomeric means 6 for the application of a counter pressure (and resulting counter force) uniformly across the functional length of the shutter prevents the occurrence of such undesired movement by the shutter means throughout its entire functional length. The elastomeric means 6, of course, functions to transmit the entire force exerted by the support member 4 to the shutter means 3 with such transmission of force occurring in a manner as to apply it to the shutter means 3 uniformly along its functional length without adverse influence because of such factors as uneven surface conditions on the shutter means against which the elastomeric means 6 is acting.

As previously indicated, in the preferred embodiment, the elastomeric means 6 is of a hose-like or tubular configuration and, further, is in fluid communication with a source of fluid pressure. Accordingly, as generally depicted in the drawing, with the support member 4 positioned as illustrated, fluid under superatmospheric pressure can be directed to the interior of the elastomeric tubular means 6 and in so doing even increasing the pressure and resulting counter force against the shutter means 3.

Also, further various embodiments and modifications of the invention are contemplated. For example, in the drawing only a single elastomeric means 6 is illustrated. It should be made clear that a plurality of such elastomeric means 6 may be employed. For example, there may be a plurality of relatively shorter segments of such elastomeric means generally functionally aligned over the span of the shutter means 3 and situated in selected areas thereof as to thereby be able to variably influence certain selected points or areas of the shutter means independently of the influence exercised on other points or areas of the shutter means. In such an arrangement where fluid pressure were to be employed for pressurizing the plurality of elastomeric segments, it would be possible, of course, to have the pressure in each elastomeric segment controlled as by a respective separate pressure regulating means or valve as generally depicted at 24.

Further, it would, of course, be possible to provide two or more elastomeric means 6 or portions thereof at respectively different elevations. That is, referring to the drawing, it would be possible to, for example, provide a second portion of such elastomeric means 6 or even a second elastomeric means 6 at an elevation generally above that at which the single elastomeric means 6 is depicted in the drawing. Such elevated additional elastomeric means could, of course, be in accordance with any of the embodiments, or modifications thereof, hereinbefore described with reference to the preferred embodiment of the invention.

Although the elastomeric means 6, in the preferred embodiment, is comprised of rubber, any suitable elastomeric material may, of course, be employed.

It should be pointed out that the prior art, as disclosed by the Federal Republic of Germany Letters Patent No. 1,461,176 teaches a breast box construction in which the front wall thereof is braced against a support with the interposition of a pneumatic cushion. However, the breast box of said German Letters Patent is of a construction and type other than that as concerns this invention. That is the breast box of said German Letters Patent is the type wherein the interior of the entire breast box is subjected to a high magnitude superatmospheric pressure and wherein the entire structurally heavy front wall thereof has to be held straight. In contrast, in the case of the invention, the problem involved is the maintaining of an extremely sensitive setting of an important individual element with such being the shutter.

Although only a preferred embodiment and certain other embodiments and modifications of the invention have been disclosed and described, it is apparent that other embodiments and modifications of the invention are possible within the scope of the appended claims.

What is claimed is:

1. A breast box nozzle assembly, comprising nozzle passage means terminating in a nozzle passage discharge orifice for the flow therethrough of a fluid stream of pulp stock, said nozzle passage means comprising at least upper disposed lip structure means, a mounting surface carried by said lip structure means, a shutter situated against said mounting surface carried by said lip structure means and adjustably movable along said mounting surface in at least two directions for adjustably determining the effective opening and effective configuration of said discharge orifice, when moved in a first of said two directions along said mounting surface said shutter extending generally transversely relatively further into said stream of fluid pulp, when moved in a second of said two directions opposite to said first direction and along said mounting surface said shutter extending generally transversely relatively less into said stream of fluid pulp, adjustment means for adjustably moving said shutter in said first and second directions, and support means for operatively applying a counter pressure to a downstream side of said shutter which counter pressure opposes the fluid pressure applied to an upstream side of said shutter by said stream of fluid pulp and urges said shutter against said mounting surface, said support means comprising a support member and elastomeric means operatively interposed between said support member and said downstream side of said shutter, said elastomeric means being effective to react against said support member and apply a reacting force as said counter pressure to said downstream side of said shutter to thereby hold said shutter against said mounting surface while still permitting said adjustment means to adjustably move said shutter in either of said first and second directions.

2. A breast box nozzle assembly according to claim 1 wherein said elastomeric means comprises a generally tubular member, and wherein said tubular member is filled with a fluid medium.

3. A breast box nozzle assembly according to claim 1 wherein said elastomeric means comprises a plurality of generally tubular members, and wherein each generally tubular member is filled with a fluid medium.

4. A breast box nozzle assembly according to claim 2 wherein said tubular member is in fluid communication with means supplying a fluid pressure, and wherein said fluid medium orginates from said means supplying a fluid pressure and is at a magnitude of pressure substantially in excess of atmospheric pressure.

5. A breast box nozzle assembly according to claim 4 and further comprising pressure regulating means effective for variably selecting the magnitude of the pressure of said fluid medium within said tubular member.

6. A breast box nozzle assembly according to claim 1 wherein said elastomeric means comprises a generally axially extending tubular member, a recess-like portion carried by said support member and extending generally horizontally, wherein said tubular member is generally received by said recess-like portion as to have an axially extending portion of the wall of said tubular member project beyond said recess-like portion and said support member and be in operative engagement with said downstream side of said shutter, wherein said tubular member is filled with a fluid medium, wherein said tubular member is in fluid communication with means supplying a fluid pressure, and wherein said fluid medium originates from said means supplying a fluid pressure and is at a magnitude of pressure substantially in excess of atmospheric pressure.

* * * * *